US006732866B2

(12) United States Patent
Fast et al.

(10) Patent No.: US 6,732,866 B2
(45) Date of Patent: May 11, 2004

(54) COMBINATION SHELF AND DISPLAY UNIT

(75) Inventors: Jacob Fast, Boca Raton, FL (US); Robert Fast, Fort Lauderdale, FL (US); Michael G. Lowry, Margate, FL (US)

(73) Assignee: East Industries, Ltd., Fort Lauderdale, FL (US)

( * ) Notice: Subject to any disclaimer, the term of this patent is extended or adjusted under 35 U.S.C. 154(b) by 260 days.

(21) Appl. No.: 10/128,267

(22) Filed: Apr. 24, 2002

(65) Prior Publication Data

US 2003/0201203 A1 Oct. 30, 2003

(51) Int. Cl.[7] ..... B65D 79/00; G09F 3/18; A47F 7/08

(52) U.S. Cl. ..... 206/527; 40/642.02; 211/36; 211/34

(58) Field of Search ..... 206/527, 278, 206/292, 295; 40/661.03, 642.01, 642.02; 211/34, 36, 59.2, 59.3, 119.003, 71, 74, 90; 248/220.21, 220.22, 221.11, 222.11

(56) References Cited

U.S. PATENT DOCUMENTS 5,060,897 A * 10/1991 Thalenfeld ..... 248/220.22
5,392,547 A * 2/1995 Mason ..... 40/661.06
5,931,426 A * 8/1999 Heckner ..... 248/220.21
6,105,295 A * 8/2000 Brinkman et al. ..... 40/661.03
6,470,613 B1 * 10/2002 Wildrick ..... 40/661.03

* cited by examiner

*Primary Examiner*—Mickey Yu
*Assistant Examiner*—Gregory Pickett
(74) *Attorney, Agent, or Firm*—Jacobson Holman PLLC

(57) ABSTRACT

A display unit for use in combination with a shelf having a depressed well at its front end, the display unit providing a stop for merchandise resting on the shelf and being formed of a multiplicity of integrally formed panels, portions of which can be seated and locked into the well of the shelf, with other portions then being interengaged to rigidify the unit and preclude accidental collapse.

10 Claims, 5 Drawing Sheets

COMBINATION SHELF AND DISPLAY UNIT

BACKGROUND OF THE INVENTION

1. Field of the Invention

This invention relates to merchandise aids and relates more particularly to a display unit adapted for use with a merchandise shelf normally supported at a downwardly extending angle and having a depressed well in the forward portion thereof for reception of a stop member designed to support merchandise and prevent the same from sliding off the shelf. Shelf systems of this type may be used by many vendors and adapted to support and display various items to customers passing by. The particular shelf configuration for which the display unit of this invention has been designed is featured in Target® stores and primarily used to support boxes containing shoes.

2. Description of the Related Art

A prior art display unit is illustrated in FIG. 1 in combination with a shelf system of the type described. The shelf 10 is seen as supported at a forwardly and downwardly extending angle in any conventional manner schematically shown in FIG. 1 as a bracket 12, and includes an upper surface 14 adapted to support merchandise for display, such as a shoe box or the like 16. A stop element is required to preclude the merchandise 16 from sliding off the forward end of the shelf 10. A prior art embodiment of one such stop element is shown at 18.

The shelf 10 includes a depressed well 20, including a front wall 22, a rear wall 24 and a bottom wall 26. A channel 28 communicates with the well 20 through the rear wall 24 and defines a lip or shoulder 30 at the rear end of the well 20. Of course, such a display would commonly include a series of shelves at different levels, usually formed of metal.

The prior art stop element 18 includes an inverted U-shaped member comprising a front wall 32 and a rear wall 34 resiliently interconnected at the bight 36, with the front wall 32 extending downwardly to form a front support leg 38, and the rear wall 34 defining a stop for the merchandise 16, and extending downwardly to form a rear support leg 40 including a rearwardly extending locking portion 42 adapted to engage under the shoulder 30.

The shelf 10 may include an arcuate bull nose forward portion 44 with a lower edge portion 46, and the prior art display unit 18 is provided with a forwardly-extending, complementary arcuate portion 48, with a reverted lower edge 50 adapted to engage over the edge portion 46 of the shelf 10.

A transparent cover member 52 may be resiliently connected at 54 to the arcuate portion 48 of the prior art display unit 18 to define a pocket 56 for reception of a paper or plastic label to provide information regarding the merchandise 16 on the shelf 10.

In order to engage the prior art display unit 18 with the shelf 10, the reverted portion 50 is engaged over the edge portion 46 of the bull nose portion 44 of the shelf 10 and the portions 32, 34 of the display unit are squeezed together to permit the legs 38, 40 to be seated in the well 20. Upon release, the leg 40 springs rearwardly to engage the locking portion 42 beneath the lip 30.

If the merchandise 16 is relatively heavy, or if the prior art display unit 18 has been used for a period of time and, thereby, weakened, there is a tendency for the merchandise 16, which is biased downwardly by gravity in the direction of the arrow A, to rotate the prior art display unit 18 free of its locking engagement in the well 20 of the shelf 10 as illustrated by the arrow B. If that happens, the merchandise 16 can slide free of the upper surface 14 of the shelf 10, likely damaging the merchandise and, possibly, as well as injuring customers nearby.

SUMMARY OF THE INVENTION

With the foregoing in mind, it is a primary object of this invention to provide a display unit for use in combination with a shelf of the type described which avoids the foregoing and other problems associated with prior art display units currently in use. More specifically, the display unit of this invention, when used in combination with a Target®-type shoe shelf, is easily engaged in the well of the shelf and locked in position in a manner that precludes accidental disengagement under the weight of the merchandise carried on the shelf.

Another object of this invention is to provide a combination of a shelf and display unit wherein the display unit is inexpensive to manufacture, simple to engage with the shelf and, when engaged, sufficiently rigid to support merchandise, such as shoe boxes, carried by the shelf, without collapsing in use.

Yet another object of this invention is the provision of a display unit forming a stop for merchandise carried on an angled shelf support with a positive locking member to rigidify the display unit once it has been engaged in the well of the shelf.

Still another object of this invention is to provide a combination shelf and display unit which can incorporate a label holder having a transparent cover member forming a pocket, with a positive finger-engaging edge on the cover member to facilitate inserting or removing paper or plastic labels in the pocket.

BRIEF DESCRIPTION OF THE DRAWINGS

These and other objects, features and many of the attendant advantages of the invention will be better understood upon a reading of the following detailed description when considered in connection with the accompanying drawings, wherein.

Like reference characters refer to like parts throughout the several views of the drawings.

DETAILED DESCRIPTION OF THE PREFERRED EMBODIMENTS

Figure 1:
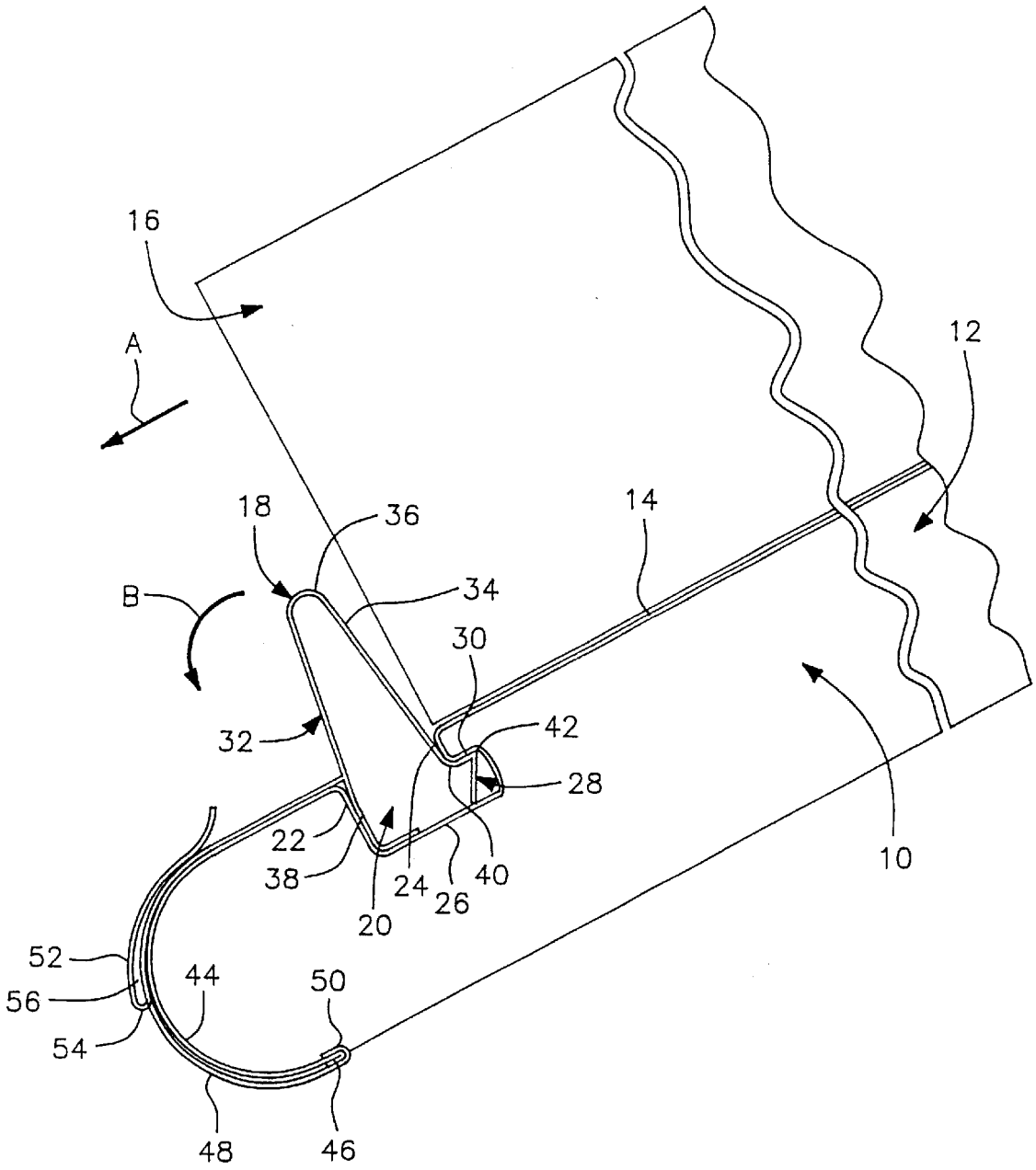
FIG. 1 (PRIOR ART)
FIG. 1 is a schematic representation of a prior art combination of shelf and display unit as described above.
Figure 2:
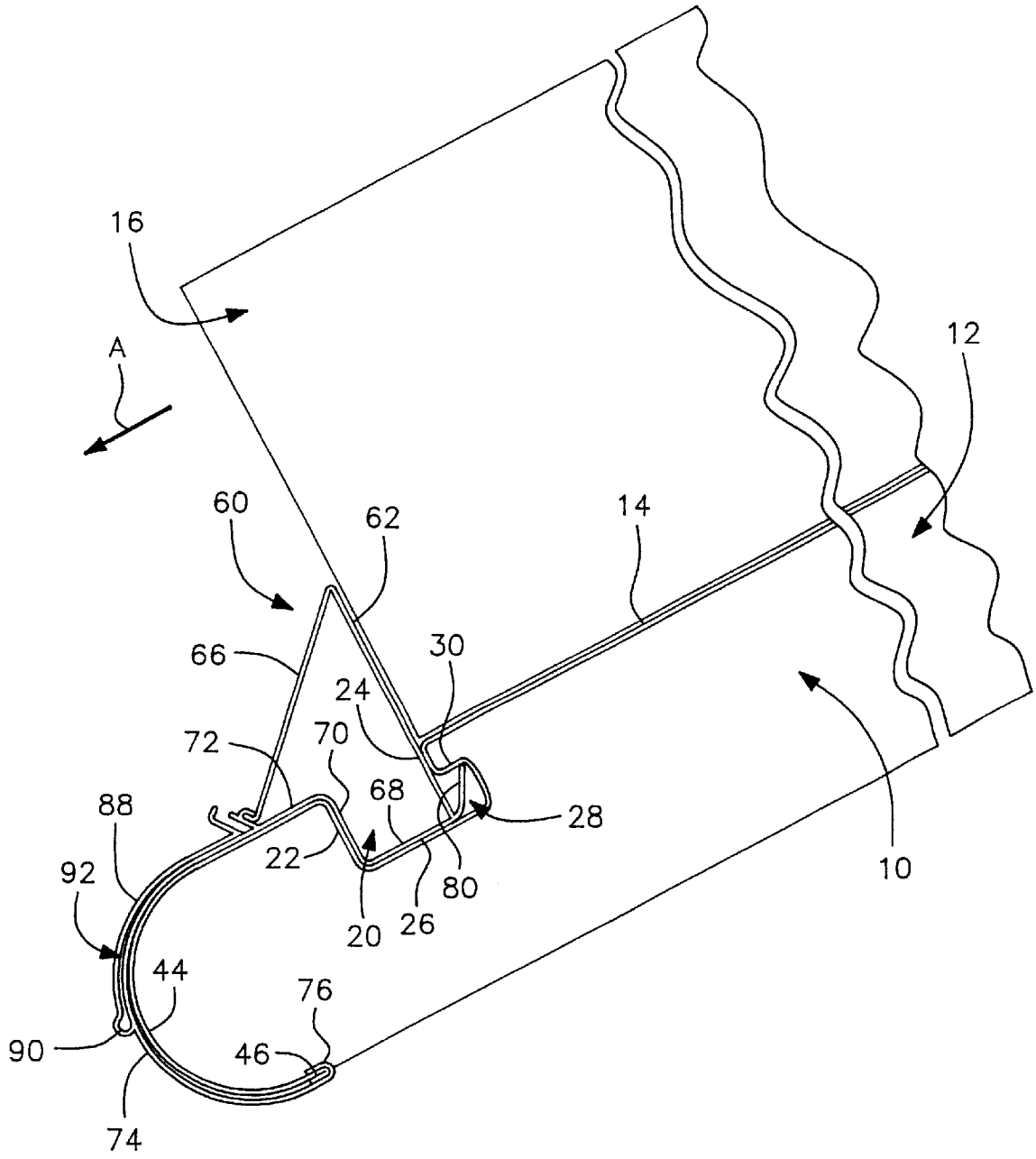
FIG. 2 is a view similar to FIG. 1, but showing the display unit of the instant invention engaged with the shelf.
Figure 3:
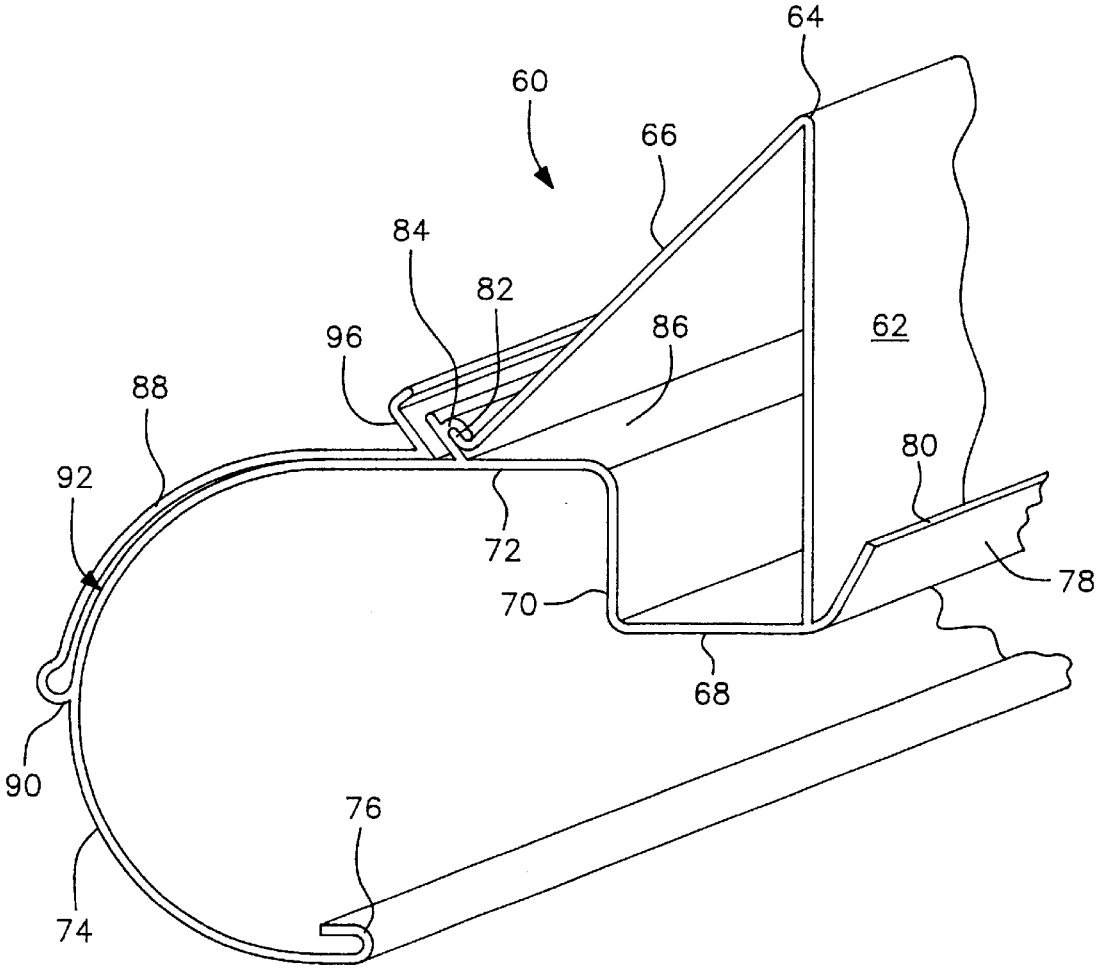
FIG. 3 is a fragmentary perspective cross-sectional view through the display unit itself.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Referring now to the drawings, and more particularly to FIGS. 2–8, the structure and use of a display unit 60 according to the instant inventive concepts is shown in combination with a shelf 10 of the type described above with the reference to the prior art display unit 18 in FIG. 1.

The display unit 60 of this invention is formed of a plurality of interconnected panels, and may be extruded or otherwise formed from any suitable polymeric material, such as polyvinyl chloride.

More specifically, the display unit 60 comprises a first panel 62 which is longer than the depth of the well 20 between the bottom wall 26 and the upper surface 14 of the shelf 10. The upper edge of the first panel 62 is angularly connected, as by an integral hinge, at 64 to the upper edge of a second panel 66, which is longer than the length of the well 20 between the front and rear walls 22, 24. The lower edge of the first panel 62 is secured to the rear edge of the third panel 68 which is slightly smaller than the length of the well 20. The front edge of the third panel 68 is secured to the lower edge of a fourth panel 70 which is slightly longer than the depth of the well 20. The upper edge of the fourth panel 70 is secured to the rear edge of a fifth panel 72 which continues forwardly and downwardly to form an arcuate front end portion 74 with a reverted terminal lip 76 adapted to engage under the free lower edge 46 of the bull nose portion 44 of the shelf 10.

A locking member 78 has a lower edge secured at the bottom or to a lower portion of the first panel 62, and extends upwardly and rearwardly therefrom to a free upper edge 80.

Complementary, interengageable, locking elements 82, 84 are formed on the lower edge of the second panel 66 and on the upper surface 86 of the forwardly extending portions of the fifth panel 72. A preferred form of such locking elements is seen in detail in FIG. 5, but it is to be understood that variations of such interengageable locking elements will be obvious to those with ordinary skill in this art and may be readily substituted for the structure illustrated herein.

Figure 7:
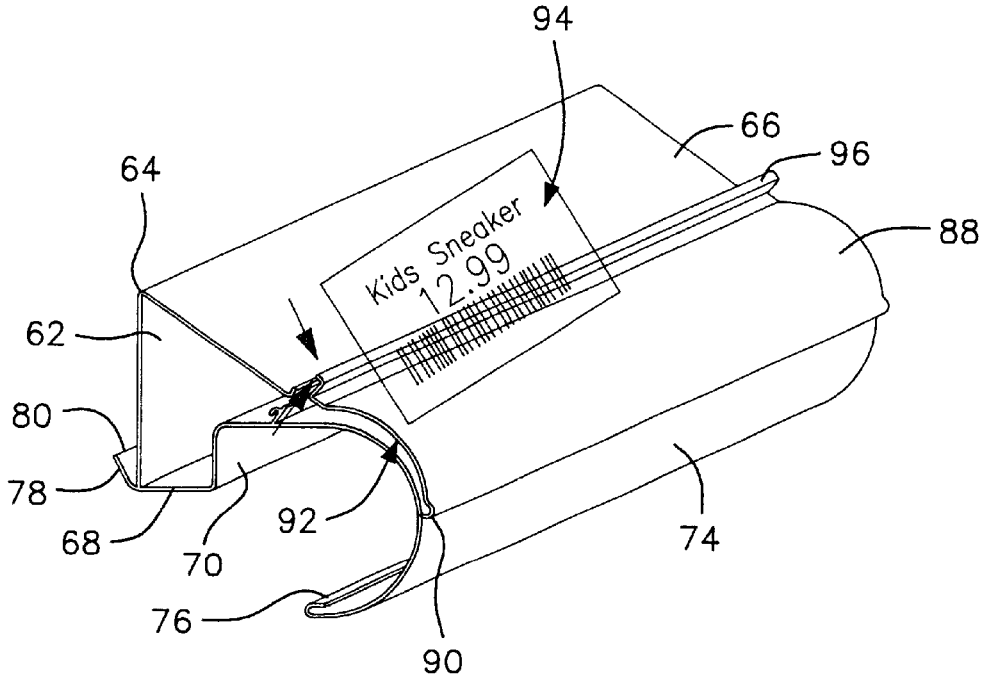
FIG. 7 is a perspective view of the display unit showing the manner in which a label can be inserted in the pocket of a label holder portion thereof.
Figure 8:
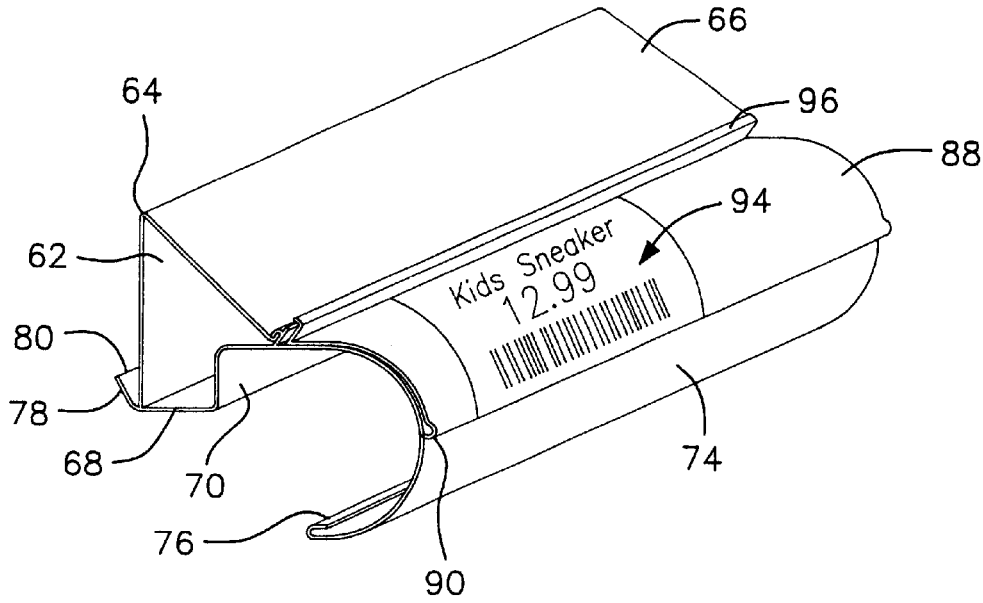
FIG. 8 is a view similar to FIG. 7, with the label fully inserted into the pocket.

A transparent cover member 88 is secured at one end 90 to the arcuate forwardly extending portion 74 of the display unit 60 to define a pocket 92 for reception of paper or plastic labels 94. An offset angular finger-engaging element 96 is preferably provided on the upper edge portions of the cover member 88 to facilitate lifting the cover member 88 to access the pocket 92 for insertion of a label as seen in FIGS. 7 and 8.

Although the foregoing description refers to the various edges of the individual panels as being secured to other panels, in practice, the entire unit is preferably integrally formed as by extrusion molding. All of the portions of the unit can be formed of the same polymer or, alternatively, different portions can be co-extruded of a different polymers. For example, if desired, the majority of the display unit 60 can be formed of an opaque polymeric material, with the cover member 88 of the label holder portion formed of a transparent material. Alternatively, the entire unit can be formed of the same transparent material, such as polyvinyl chloride.

Figure 4:
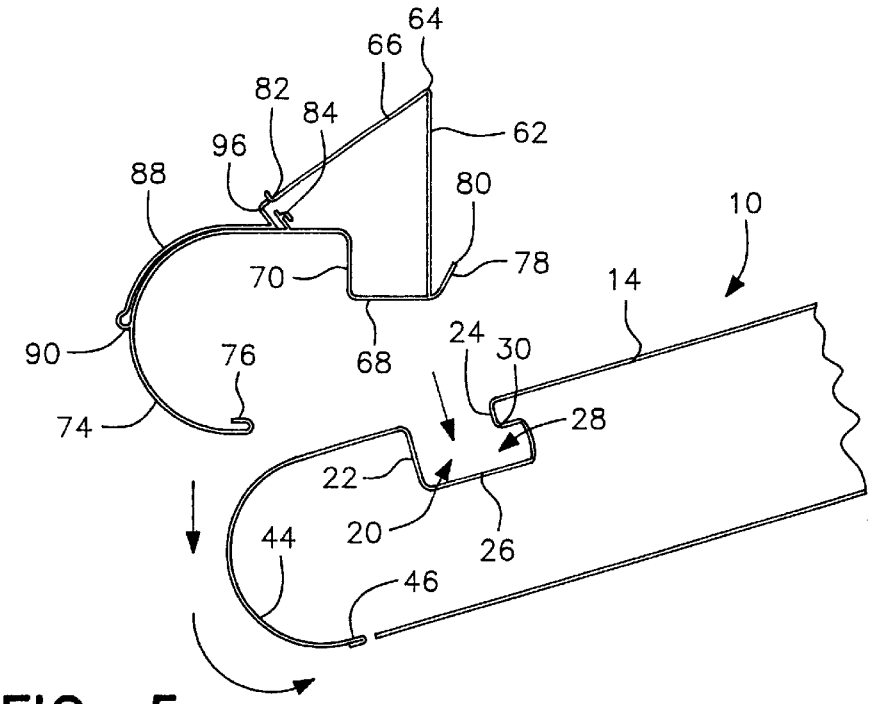
FIG. 4 illustrates the manner in which the display unit of this invention is engaged with the shelf.
Figure 5:
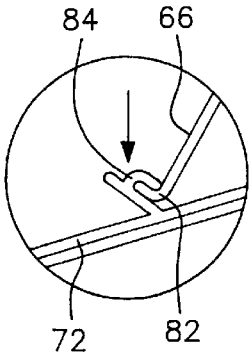
FIG. 5 is an enlarged detailed view showing the manner in which the display unit is locked to rigidify the same after it has been engaged with the shelf.
Figure 6:
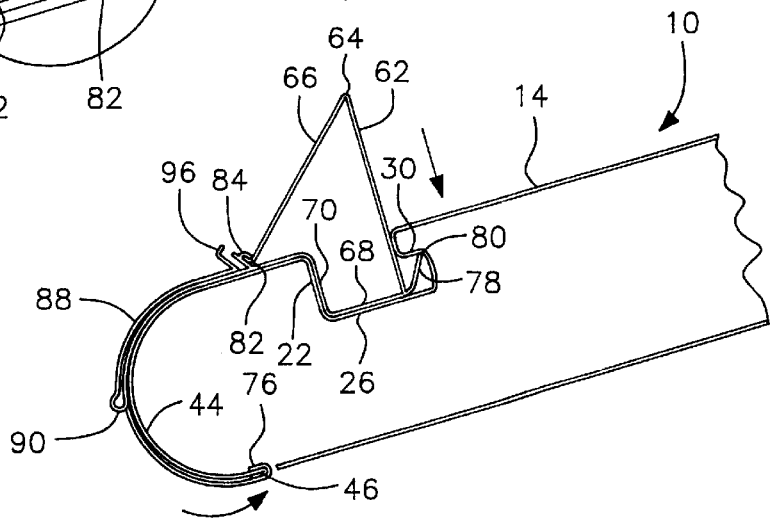
FIG. 6 is a view similar to FIG. 5, showing the display unit locked in position on the shelf.

The use and operation of the display unit 60 of the instant invention in combination with the shelf unit 10 will now be readily understood by those with ordinary skill in the art. Specifically, with the elements 82, 84 disengaged as seen in FIG. 4, the locking element 78, together with the lower portions of the first panel 62, and the third and fourth panels 68, 70, are pressed downwardly into the well 20, the locking member 78 springing back to its angular position so that its upper edge 80 lockingly engages under the lip or shoulder 30 of the shelf 10. The complementary members 82, 84 are then lockingly engaged with each other as seen in FIG. 5 to rigidify the display unit 60, effectively forming a right-triangular upper portion forming a stop surface for the merchandise 16, with an offset lower rectangular portion seated and locked into the well 20. This structure is not subject to collapse from the weight of the merchandise 16 leading to disengagement from the well 20 by rotation in the manner of the prior art display unit 18 because the elements of the display unit 60 seated in the well 20 of the shelf 10 cannot be squeezed together in normal use.

The foregoing descriptions and drawings should be considered as illustrative only of the principles of the invention. Numerous applications of the present invention will readily occur to those skilled in the art. Therefore, it is not desired to limit the invention to the preferred embodiments or the exact construction and operation shown and described. Rather, all suitable modifications and equivalents may be resorted to, falling within the scope of the invention.

What is claimed is:

1. In combination, a shelf and a display unit, said shelf comprising a generally planar support member having front and rear ends and an upper surface, a depressed well formed toward said front end, said well being defined by a front wall, a rear wall and a bottom wall, said well having a depth measured from said bottom wall to said upper surface of said support member, and a length measured between said front and rear walls, and a channel communicating with said rear wall of said well and underlying said support member to define a lip at that end of the well, said display unit comprising a first panel having an upper edge and a lower edge, said first panel having a height between its upper and lower edges greater than said depth of said well, a second panel having an upper edge and a lower edge, said upper edge of said second panel being hingedly connected at an angle to said upper edge of said first panel, said second panel having a length between its upper and lower edges greater than said length of said well, a third panel having a front edge and a rear edge, said rear edge of said third panel being secured to said lower edge of said first panel, said third panel having a length between its front and rear edges less than said length of said well, a fourth panel having a lower edge and an upper edge, said lower edge of said fourth panel being secured to said front edge of said third panel, said fourth panel having a height between its lower and upper edges greater than said depth of said well, and a fifth panel having a rear edge secured to said upper edge of said fourth panel and having portions with an upper surface extending forwardly therefrom, a locking member having a lower edge secured to a lower portion of said first panel, said locking member extending upwardly and rearwardly therefrom to a free upper edge, and complementary, selectively interengageable, members on said lower edge of said second panel and said upper surface of forwardly-extending portions of said fifth panel to secure said panels together to form a relatively rigid, generally right-triangular, upper portion and a relatively rigid lower portion formed from the lower portion of said first panel together with said third and fourth panels, said lower portion of said display unit adapted to be seated in said well with said locking member extending into said channel and engaged under said lip to secure said display unit to said shelf and with the upper portion of said first panel extending above said upper surface of said support member to define a stop for articles carried by said support member.

2. The combination of claim 1, wherein said panels are integrally formed of a plastic material and the hinged connection between said upper edges of said first and second panels is an integral hinge.

3. The combination of claim 2, wherein said plastic material is polyvinyl chloride.

4. The combination of claim 1, wherein said shelf includes an arcuate bull nose portion extending forwardly of said well and downwardly to a free lower edge, and wherein said forwardly-extending portion of said fifth panel includes a complementary arcuate front end portion with a reverted terminal lip adapted to engage under said free lower edge of said bull nose portion of said shelf to further secure said display unit to said shelf.

5. The combination of claim 4, further including a label holder comprising an arcuate, flexible, transparent cover member having a forward edge connected to said upper surface of said arcuate front end portion of said fifth panel to slidably receive a paper label or the like in a pocket formed between said cover member and said front end portion of said fifth panel.

6. The combination of claim 5, wherein a rearward edge portion of said cover member includes a finger-engaging element to facilitate opening said pocket.

7. The combination of claim 1 wherein said shelf with said shelf upper surface is angled forwardly and downwardly.

8. The combination of claim 7, further including at least one display article carried on said upper surface of said shelf and engaged by gravity with said stop.

9. The combination of claim 8, wherein said display article comprises a box.

10. The combination of claim 9, wherein said box is a shoebox.

* * * * *